United States Patent [19]

Von Viebahn et al.

[11] 4,192,632

[45] Mar. 11, 1980

[54] SUPPORT SYSTEMS FOR MINERAL MINING INSTALLATIONS

[75] Inventors: Hans E. Von Viebahn; Julius Tengler, both of Lünen, Fed. Rep. of Germany

[73] Assignee: Gewerkschaft Eisenhutte Westfalia, Lünen, Fed. Rep. of Germany

[21] Appl. No.: 912,475

[22] Filed: Jun. 5, 1978

[30] Foreign Application Priority Data

Jul. 16, 1977 [DE] Fed. Rep. of Germany ..... 2732339

[51] Int. Cl.[2] ..... E21D 17/00; E21D 23/06

[52] U.S. Cl. ..... 405/298; 405/145; 405/291

[58] Field of Search ..... 405/290, 291, 292, 296, 405/298, 145

[56] References Cited

U.S. PATENT DOCUMENTS

| | | | |
|---|---|---|---|
| 834,732 | 10/1906 | Japp | 405/145 |
| 3,240,022 | 3/1966 | Mills et al. | 405/298 |
| 3,564,857 | 2/1971 | Hippel | 405/296 |
| 3,581,507 | 1/1971 | Stevens | 405/145 |
| 3,791,151 | 2/1974 | Plank | 405/282 |
| 3,812,680 | 5/1974 | Walbrohl | 405/290 |
| 3,872,678 | 3/1975 | Shuttleworth | 405/296 X |
| 3,874,734 | 4/1975 | Plevak et al. | 405/290 X |
| 3,991,577 | 11/1976 | Thevenoux | 405/291 |
| 4,063,425 | 12/1977 | Jutte et al. | 405/145 |

FOREIGN PATENT DOCUMENTS

| | | | |
|---|---|---|---|
| 1134947 | 8/1962 | Fed. Rep. of Germany | 405/290 |
| 1291436 | 10/1972 | United Kingdom | 405/291 |

*Primary Examiner*—Dennis L. Taylor

*Attorney, Agent, or Firm*—Pfund, Charles E.

[57] ABSTRACT

A mineral mining installation has a longwall scraper-chain conveyor with a machine, such as a plough, guided for movement back and forth alongside the conveyor to win mineral from a longwall face. A roof support system which may be arranged at the ends of the longwall working, i.e., at the so-called stable zones, is composed of several units each with hydraulic props protected within cylindrical telescopic casings. Each support unit may be displaceable as a whole to follow the working progress or else each support unit may be constructed with front and rear frame assemblies which are relatively displaceable. Each support unit has at least five narrow elongate roof bars disposed closely side-by-side in parallelism. The roof bars are guided for longitudinal advancement and hydraulic rams serve to advance the roof bars individually or in groups. A similar arrangement may also be employed as the floor structure of each support unit.

20 Claims, 6 Drawing Figures

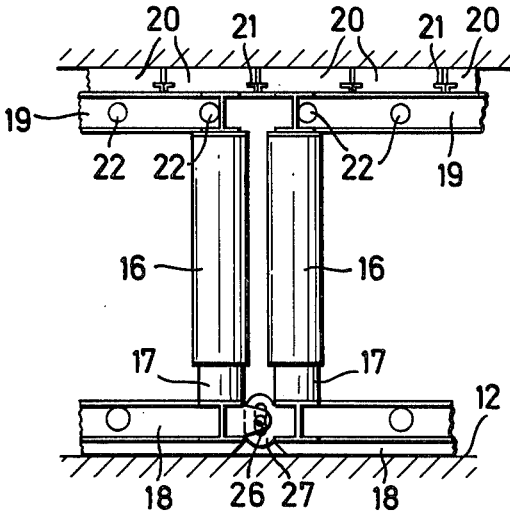
FIG. 3
FIG. 4
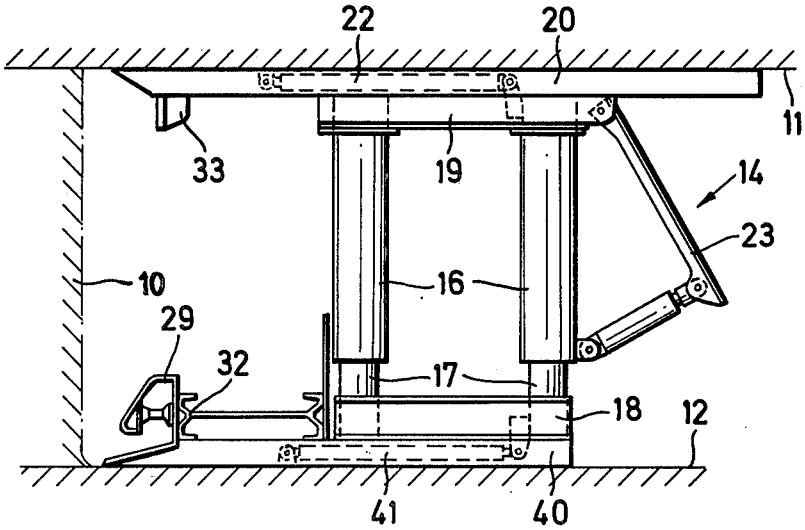

SUPPORT SYSTEMS FOR MINERAL MINING INSTALLATIONS

BACKGROUND TO THE INVENTION

The present invention relates in general to mineral mining installations, especially longwall installations, and to roof support systems usable in such installations.

In the field of mine installation roof support systems are known in a whole variety of constructions. Usually, however, conventional roof support systems are composed of individual chocks or units, with hydraulic props interposed between roof and floor-engaging structures. Shifting rams connect the units to a scraper-chain conveyor and serve to advance the latter, usually with a machine guide. The units can follow up the working progress by retraction of the shifting rams. During the shifting of the support units the props are retracted or at least partially relieved and this can leave comparatively large areas of the roof temporarily unsupported. In longwall workings, it is common to advance the conveyor and guide means after each passage of the cutting machine or plough and to draw up the support units in short steps. The repeated support and relief of the roof often leads to problems.

A general object of this invention is to provide support systems and units which will at least mitigate some of these problems.

SUMMARY OF THE INVENTION

According to the invention the roof-engaging structure of a roof support unit is composed of a multiplicity of narrow long roof bars which are individually displaceable. Thus in its broadest aspect the invention provides at least one roof support unit which comprises hydraulic props and a plurality of elongate narrow roof bars carried by the props, the roof bars being arranged in side-by-side parallel relationship for individual longitudinal displacement.

The roof bars are preferably arranged in closely-adjacent side-by-side relationship and preferably at least five such narrow roof bars are provided. The roof bars are preferably guided for longitudinal displacement and means, such as hydraulic rams, serve to advance the roof bars individually or in groups. Although each roof bar may have its own ram allocated to it it is possible to drive several roof bars with one ram. A support unit or system constructed in accordance with the invention can be relatively simple and less costly than more complex constructions yet the provision of a great number of roof bars enables the roof to be adequately supported and underpinned over a relatively large area between the mineral, e.g. coal, face and the goaf or stowage zone.

In general the individual roof bars, which only contact a portion of the roof in the order of 20 to 50 c.m. and more preferably 25 to 35 cm. in width, can be advanced under load preserving adequate roof support at all times. By utilizing double-acting rams to advance the roof bars, these rams can also be used collectively to shift the remainder of the support unit, preferably in conjunction with other conventional shifting rams operating at the floor region.

The props of the support unit or system can be protected within upper and lower casings which surround the props and extend or retract in telescopic fashion when the props similarly operate.

The support unit or system constructed in accordance with the invention can take a variety of detailed forms. In one embodiment the props and their protective casings are mounted between rigid roof and floor frames wherein the roof bars are carried and guided on the roof frame. The rams for displacing the roof bars can be accommodated in a protected position within the roof frame.

It is also practicable to provide a plurality of floor rails, constructed and arranged in a similar manner to the aforementioned roof bars. Hydraulic rams can then be used to advance the floor rails individually or in groups. The overall length of the roof bars, and the floor rails when employed, would generally be somewhat greater than the corresponding dimension of the support unit or system in the advancing direction and can be substantially the same as the width of the longwall working.

Instead of utilizing floor and roof-frames providing horizontal stability or rigidity at the floor and roof zones it is possible to adopt a modified design with stability or rigidity over vertical front and rear regions. Hence the props of the thus-modified support unit can be combined with means, such as frame structure components, to form a front and a rear frame assembly. These frame assemblies can be relatively displaceable and can carry the roof bars. In one embodiment of this design, the roof bars are slidably guided on the rear frame assembly but connected to move with the front frame assembly. Hydraulic rams can then displace the front frame assembly and the roof bars in relation to the rear frame assembly and vice versa. These rams can be located at the roof and floor zones. In this construction also floor rails, analogous to the roof bars, can be employed. The roof bars need not necessarily move with the front frame assembly and the roof bars can move in relation to both frame assemblies. Hydraulic rams can advance the roof bars or the roof bars and the floor rails, in relation to both the front and rear frame assemblies. In addition, rams can be provided to displace one frame assembly in relation to the other.

Several support units or a support system made in accordance with the invention may be arranged alongside a longwall conveyor having a main machine or plough guide at the other, mineral face, side. Additional machine guides can be carried by the roof bars of the support units. Where the support units employ floor rails, the conveyor and/or the guide can be supported by the floor rails.

In the case where the support units each employ front and rear frame assemblies then the conveyor can be disposed between the assemblies and the guide can be disposed in front of the front frame assembly near the mineral face. The conveyor and main guide can move with the front frame assembly of each support unit but the conveyor and/or the guide can be moved independently. In all cases, the main guide or guides can be progressively advanced in stages after the winning machine or plough has completed a cutting run and the roof bars can be similarly advanced. The support units can employ goaf shields as known per se.

The invention may be understood more readily, and various other features of the invention may become apparent from consideration of the following description.

BRIEF DESCRIPTION OF DRAWINGS

Embodiments of the invention will now be described, by way of examples only, with reference to the accompanying drawings, wherein:

FIG. 3 is a front view of part of the installation shown in FIGS. 1 and 2 the view being taken in the direction of the arrows III—III of FIG. 2; and FIGS. 4 to 6 are respective side elevations of other forms of installation made in accordance with the invention.

DESCRIPTION OF PREFERRED EMBODIMENTS

Figure 1:
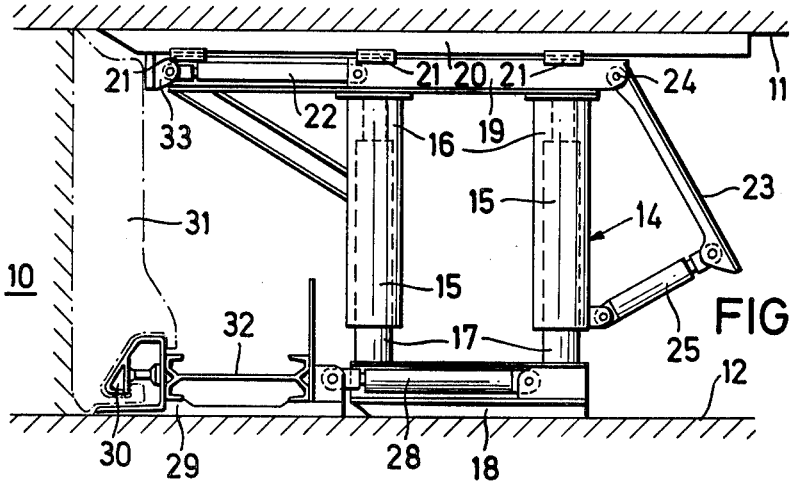
FIG. 1 is a side elevation of a mineral mining installation, made in accordance with the invention.
Figure 2:
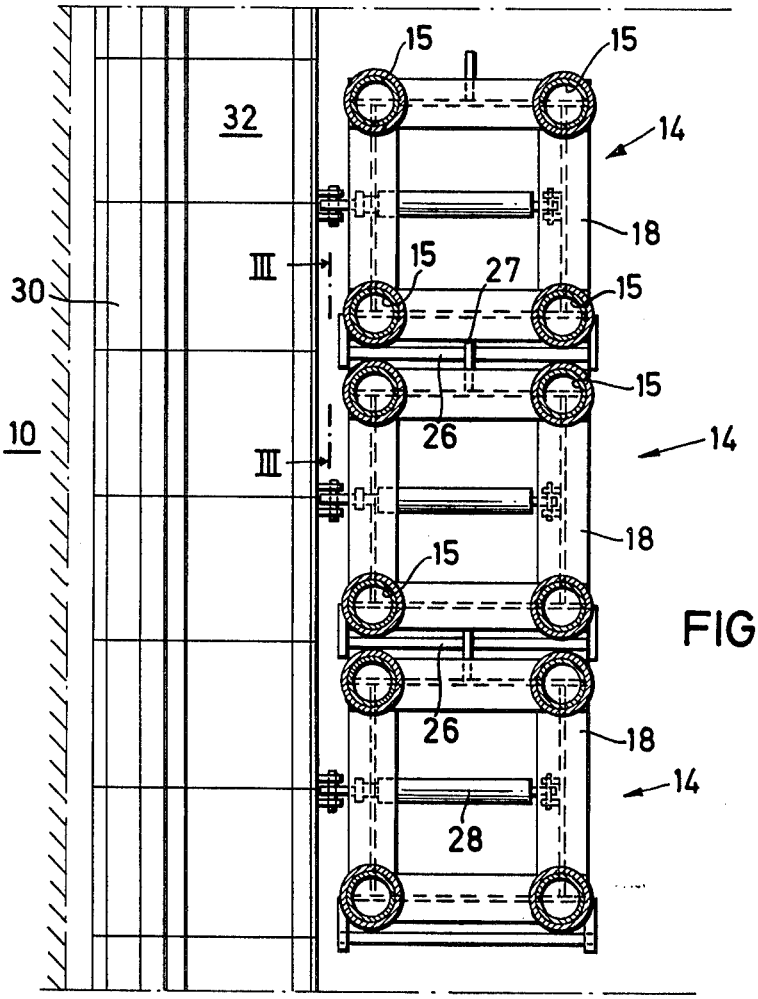
FIG. 2 is a part-sectional plan view of the installation shown in FIG. 1.

As shown in FIGS. 1 to 3, a mineral mining installation, employing a support system and support units made in accordance with the invention, is depicted in at least part of a longwall working with a mineral, e.g. coal, face 10, a roof 11 and a floor 12. The support system is composed of a plurality of units or frames 14 arranged at the side of a scraper-chain conveyor 32 remote from the mineral face 10. Each support unit 14 has a floor-engaging sill or skid structure which is here in the form of an open rectangular frame 18 assembled from bars or the like. Above the floor frame 18 there is an open rectangular roof frame 19 which is constructed in a similar manner to the floor frame 18 but has in addition angular stiffening struts as shown in FIG. 1.

Each support unit 14 is provided with four hydraulic props 15 arranged at the corners of the frames 18, 19 to form a rectangular array as shown in FIG. 2. The props 15 are extendible and retractible in known manner to raise and lower the roof frame 19 of the support unit 14. Each prop 15 is located inside protective upper and lower casings 16, 17. The lower casings 17 are rigidly connected to the floor frame 18 while the upper casings 16 are rigidly connected to the roof frame 19 and preferably also to the stiffening struts. Each pair of casings 16, 17, associated with each prop 15 are arranged in telescopic manner to extend and retract with the associated prop 15.

The roof frame 19 of each support unit 14 carries a plurality of roof-engaging bars 20. These roof bars 20 extend side-by-side in parallelism and are each slidably movable in the direction of its longitudinal axis. Guide means, such as T-shaped recesses and guide blocks 21 (FIG. 3), are provided between the roof frame 19 and the roof bars 20 to guide the latter. To effect the movement of the roof bars 20 of each support unit double-acting hydraulic rams 22 are provided. Each roof bar 20 may have its own associated ram 22 which is mounted in a protected manner inside the roof frame 19 as shown in FIG. 3. Each ram 22 has its cylinder connected to the frame 19 and its piston rod pivotably connected to the associated roof bar 20. Each roof bar 20 has a considerable length to engage on the roof 11 over a zone extending from the face 10 to the goaf zone. Each unit 14 would have, typically, from five to ten roof bars 20 each having a width of 30 cm. for example. The roof bars 20 of each unit 14 lie closely adjacent one another to provide a combined roof cap. The units 14, are, in addition, arranged closely adjacent one another so that the roof bars 20 of adjacent units 14 also lie closely adjacent one another (FIG. 3). Hence, all the bars 20 can form a combined roof canopy extending over a considerable area over the width and at least part of the length of the longwall working.

As shown in FIG. 1, each unit 14 also has a goaf shield 23 which is pivotably connected at its upper end to the roof frame 19 of the unit at a pivot joint 24. Hydraulic piston and cylinder units 25 are pivotably connected to the lower part of the shield 23 and to the upper casings 16 of the unit 14. These units 25 can be extended and retracted to adjust the position of the goaf shield 23. Since the units 14 are closely adjacent the individual goaf shield 23 form a combined screen extending across the goaf zone.

The units 14 of the support system are relatively displaceable to follow the winning progress. To this end the floor frame 18 of each unit 14 supports the cylinder of a double-acting hydraulic ram 28 and the rams 28 have their piston rods pivotably connected to a floor-engaging skid 29 which supports the conveyor 32. The skid 29 is preferably of composite form and composed of a plurality of articulated sections which are relatively displaceable to a limited extent to cope with the prevailing conditions. A guide 30 is disposed at the mineral face side of the conveyor 32 and the guide 30 is supported by the skid 29 and is fixed to the conveyor 32. The guide 30, which may also be composed of interconnected sections, supports and guides a mineral winning machine, such as a plough, (not shown) which is moved back and forth along the face 10 to strip mineral therefrom in known manner. The mineral detached from the face 10 is then transferred by means of the conveyor 32 also in known manner. The skid 29, the conveyor 32 and the guide 30 form a constructional assembly movable as a whole towards the face 10 with the aid of the rams 28 when the props 15 are braced between the floor 12 and the roof 11. Each unit 14 can be shifted to follow up advancement of the assembly 29, 30, 32 by retracting or relieving the props 15 thereof and by retracting the shifting ram 28. The units 14 are guided during their advancement by guide means provided on adjacent units 14. This guide means takes the form of guide rails 26 and guide blocks 27 supported by the floor frames 18 of the units 14. Thus, as shown in FIG. 2, the frame 18 of one unit 14 has a guide block 27 slidably mounted on a guide rail 26 of the frame 18 of an adjacent unit 14. Preferably the guide blocks 27 have vertically-orientated slots receiving the guide rails 26 to permit slight relative vertical movement between the adjacent frames 18.

Where the mineral winning machine or plough wins the mineral over the entire height of the face or seam 10, as depicted in FIG. 1, the plough is additionally guided by guides 33 carried at the underside of the front regions of the bars 20. During operation, the assembly 29, 30, 32 is advanced with the rams 28 after each cutting run of the plough to the depth of cut of the plough and the roof bars 20 are extended through a corresponding distance by means of the rams 22. The roof bars 20 can be advanced individually or collectively or in groups. In general it may be possible for the roof bars 20 to be advanced without relieving the props 15 of the associated support unit 14 but partial relief of the props 15 can be effected if desired. After the assembly 29, 30, 32 and/or the roof bars 20 have been advanced to the full stroke of the rams 28 and/or 22, the units 14 are shifted up by at least partially relieving the props 15 and retracting the rams 28 in sequence. At the same time the rams 22 are retracted to draw the roof frames 19 up and preferably the roof bars 20 are held in frictional contact with the roof 11 to act as an abutment for the rams 22.

It is desirable to extend and retract the rams 22 and 28 in question at the same rate.

In the embodiment shown in FIG. 4 like reference numerals are used to denote like parts. In contrast to the construction shown in FIGS. 1 to 3, the floor frame 18 of each unit 14 of the FIG. 4 installation rest on floor rails 40 which correspond to the roof bars 20. Thus, the floor rails 40 are guided for longitudinal displacement in relation to the floor frame 18 of the associated unit 14 in a similar manner to the roof bars 20 in relation to the roof frame 19. Double-acting hydraulic rams 41 are pivotably connected between the floor rails 41 and the floor frame 18 and serve to displace the rails 40 as the rams 22 serve the displace the bars 20. The forward regions of the floor rails 40 serve to support the conveyor 32 and the guide 29 is connected or fixed to the front ends of the rails 40.

The floor rails 40, the conveyor 32 and the guide 29 thus form an assembly which is advanced progressively with the rams 41 after each cutting run of the plough along the mineral face 10. As before, the roof bars 20 with their guides 33 would also be progressively advanced, singly or in groups with the rams 22 to synchronize with the advancement of the floor rails 40. The units 14 would be drawn up in the manner described when the rams 22, 41 have been fully extended.

Figure 5:
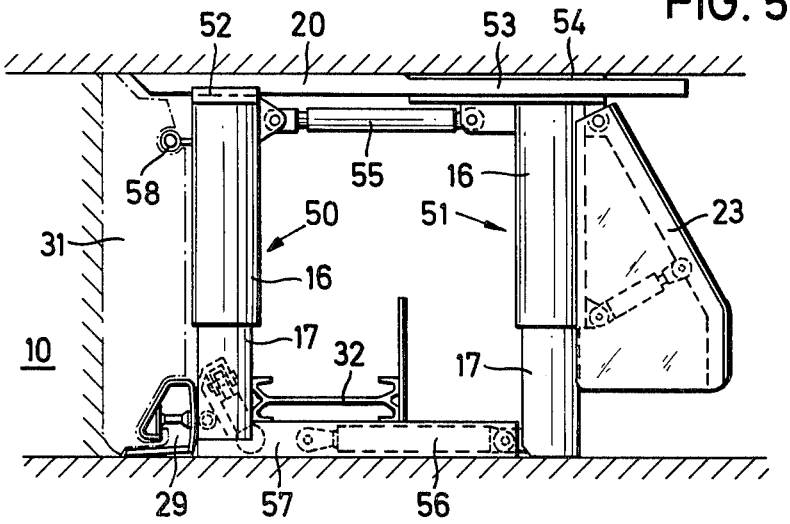

In the embodiment shown in FIG. 5, each support unit is composed of a forward frame assembly 50 and a rear frame assembly 51. The frame assemblies 50, 51 are relatively displaceable and each frame assembly 50, 51 has hydraulic props located in telescopic casings 16, 17 in the manner described previously. The upper casings 16 of each frame assembly 50, 51 may be interconnected by an upper beam or the like extending parallel to the mineral face 10. The lower casings 17 of the front frame assembly 50 are supported by and connected with a floor frame 57 and the lower casings 17 of the rear frame assembly 51 may be interconnected by a lower beam or the like extending parallel to the mineral face 10. The rear frame assembly 51 is provided with a goaf shield 23 as shown. Each support unit has a plurality of roof bars 20 generally as described previously in connection with the other embodiments.

The roof bars 20 are fixed to the front frame assembly 50, e.g. fixed to the upper beam 52 provided at the head of the front frame assembly 50. The roof bars 20 are slidably guided with their reduced or tapered rear portions 53 in guides 54 provided at the head of the rear frame assembly 51. The guides 54 are fixed to the assembly 51, e.g., to the upper beam connecting the casings 16, and can themselves form roof-engaging components supporting the roof in the region of the rear frame assembly 51. Double-acting hydraulic rams 55, 56 are interconnected between the front and rear frame assemblies 50, 51 at the roof and floor zones. The conveyor 32 of the installation is located between the front and rear frame assemblies 50, 51 and is carried on the floor frame 57 of the front frame assembly 50. A guide 29 for a winning machine or plough, represented in chain-dotted outline 31, is connected for movement with the floor frame 57. Adjustment devices are preferably employed to tilt the guide 29 and enable adjustment thereof to thereby control the position of the plough 31. The plough 31 is also guided by a guide rail 58 attached to the upper region of the front frame assembly 50, e.g. to the casings 16. The rams 55, 56 are operated in unison to shift the front frame assembly 50 progressively forward with the roof bars 20, the conveyor 32 and the guide 29 after each cutting run of the plough 31. After the rams 55, 56 are fully extended they are retracted to draw up the frame assembly 51. The props of each frame assembly 50, 51 are preferably just partly relieved when the frame assembly 50, 51 is shifted to maintain the bars 20 and guides 54 in contact with the roof.

Figure 6:
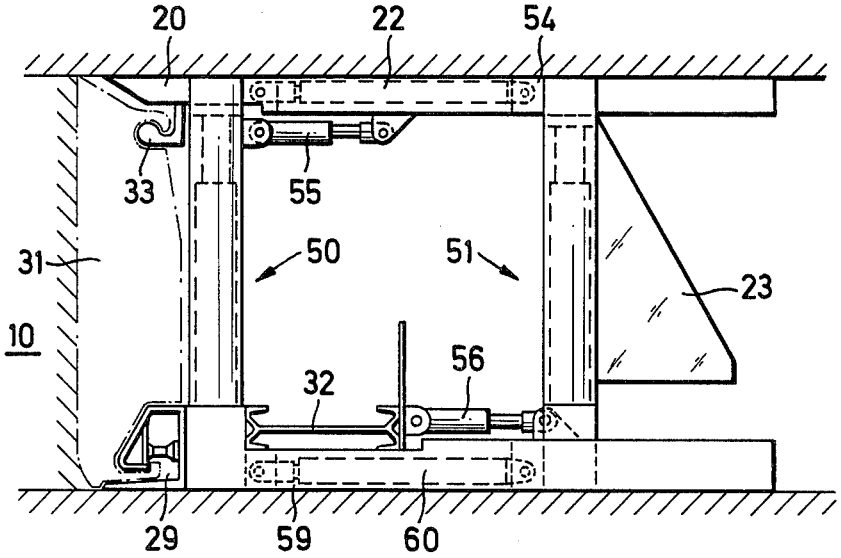

Although in the embodiment shown in FIG. 5, the roof bars 20 are rigidly connected to the front frame 50 it is possible to render the bars 20 movable in relation to this front frame assembly 50 also. FIG. 6 depicts a modified construction in which the bars 20 are thus movable in relation to both front and rear frame assemblies 50, 51. In this construction the rear frame assembly 51 has a box-like guide 54 receiving and guiding the individual roof bar 20. Each roof bar 20 is connected to a hydraulic ram 22, supported by the guide 54 and protected thereby. The floor structure is also modified in FIG. 6 and takes the form of a plurality of floor rails 59 analogous to the roof bars 20 and similar to the FIG. 5 arrangement. Hydraulic rams 60 are connected between the rear frame assembly 51 and the floor rails 59. The conveyor 32 is carried on the floor rails 59 while the guide 29 is connected for movement with one or more of the rails 59. Hydraulic rams 55 are connected between the guide 54, and hence the rear frame assembly 51, and the front frame assembly 50. Hydraulic rams 56 are connected between the conveyor 32 and the rear frame assembly 51. As in the previous embodiments, the rear frame assembly 51 is provided with a goaf shield 23, here just represented schematically. The winning machine or plough 31 is again guided by the main floor guide 29 and by one or more guides 33 carried by the roof bars 20.

The rams 22, 60 are operated in unison to advance the floor rails 59 and the roof bars 20, together with the guides 29, 33 progressively after each cutting run of the plough 31. After a certain amount of advancement, the front frame assembly 50 and the conveyor 32 are displaced towards the mineral face 10 by operating the rams 55, 56. When it is desired to draw up the rear frame assembly 51 all the rams 22, 55, 56, 60 can be retracted together.

In the embodiments described above and shown in FIGS. 5 and 6, it is generally advisable to provide a larger number of hydraulic props in the rear frame assembly 51 than in the front frame assembly 50 to provide enhance support at the breaking edge of the roof near the goaf or stowage zone. Because, in the FIG. 5 and 6 embodiments, the front frame assembly 50 is located between the guide 29 and the conveyor 32, the roof bars 20 are carried or supported at a position very close to the mineral face 10 which is advantageous.

In the embodiments shown in FIGS. 5 and 6, the rams 56, 60 extend beneath the conveyor 32. This makes it possible to modify these arrangements so that the floor of the conveyor 32 is double-walled providing a channel which can, on the one hand, receive the rams 56 or 60 and on the other hand can serve as a duct through which methane gas or dust can be removed by suction or through which ventilation air is passed, for example.

In all the embodiments described and illustrated, the roof bars 20 and/or floor rails 40, 59 can also be guided on one another and, for example, adjacent components can overlap with their longitudinal edges.

The support systems described hereinbefore and illustrated in the drawings are especially suitable for use as stable supports just at the end regions of a longwall working. In this case, a conventional support system can be used over the full longwall face and working.

We claim:

1. A support unit for use in mineral mining, said unit comprising a generally rectangular floor frame structure, hydraulic props carried by the floor frame structure, a generally rectangular roof frame structure supported by the props, a plurality of elongate narrow roof-engaging bars mounted on the roof frame structure, the roof bars being arranged in closely-adjacent side-by-side relationship with each roof bar having a width small in relation to the overall width of the unit, guide means for guiding the roof bars for mutual relative longitudinal displacement in relation to the roof frame structure and hydraulic rams connected between the roof frame structure and the roof bars for selectively displacing the roof bars.

2. A support unit according to claim 1, wherein the props are each located within a pair of telescopic casings.

3. A support unit according to claim 1 and further comprising a goaf shield connected to the roof frame structure.

4. A support unit according to claim 1, wherein, said rams are arranged in a protected position within the roof frame structure.

5. A support unit according to claim 1 and further comprising a plurality of elongate floor rails supporting the floor frame structure, the floor rails being arranged in side-by-side parallel relationship for individual longitudinal displacement.

6. A support unit according to claim 5, wherein means are provided for advancing the floor rails.

7. A mineral mining installation employing at least one support unit according to claim 1 in combination with a conveyor, guide means for guiding a mineral winning machine for movement back and forth alongside the conveyor, the guide means being movable with the conveyor and a hydraulic shifting ram connected between the conveyor and the floor frame structure of said unit.

8. An installation according to claim 7, wherein the roof bars have additional guides for guiding the mineral winning machine.

9. An installation according to claim 7, wherein the support unit has a plurality of elongate floor rails supporting the floor frame structure, the conveyor and the machine guide means and there is provided means for advancing the floor rails.

10. A support unit for use in mineral mining, said unit comprising a forward upstanding generally rectangular frame assembly, a rear upstanding generally rectangular frame assembly, each frame assembly including hydraulic props, a plurality of elongate narrow, roof-engaging bars mounted on both the forward and rear frame assemblies, the roof bars being arranged in closely-adjacent side-by-side relationship with each roof bar having a width small in relation to the overall width of the unit, means for fixing the roof bars to one of the frame assemblies, guide means for guiding the roof bars for displacement in relation to the other of the frame assemblies and hydraulic rams connected between the frame assemblies for selectively displacing the frame assemblies relative to one another.

11. A support unit according to claim 10, wherein roof bars are fixed to the front frame assembly and the rear frame assembly has said guide means which slidably guides the roof bars.

12. A support unit according to claim 10, wherein there are more props in the rear frame assembly than in the front frame assembly.

13. A support unit according to claim 10, wherein the hydraulic rams serve to interconnect the front and rear frame assemblies at both the roof and floor regions.

14. A support unit according to claim 10, wherein the props are each located within a pair of telescopic casings.

15. A mineral mining installation employing at least one support unit according to claim 10 in combination with a conveyor disposed between the forward and rear frame assemblies of the support unit, and a guide means for guiding a mineral winning machine for movement back and forth alongside the conveyor, wherein the conveyor and machine guide means are connected for movement with the forward frame assembly of the support unit.

16. A support unit for use in mineral mining, said unit comprising a forward upstanding generally rectangular frame assembly, a rear upstanding generally rectangular frame assembly, each frame assembly including hydraulic props, a plurality of elongate narrow roof-engaging bars mounted on both the forward and rear assemblies, the roof bars being arranged in closely-adjacent side-by-side relationship with each roof bar having a width small in relation to the overall width of the unit, means guiding the roof bars for longitudinal displacement in relation to the forward and rear frame assemblies, hydraulic rams for selectively displacing the roof bars, and further hydraulic rams for selectively displacing the frame assemblies relative to one another.

17. A support unit according to claim 16, and further comprising a plurality of elongate floor rails which are arranged in side-by-side parallel relationship for individual longitudinal displacement and means for advancing the floor rails in relation to the front and rear frame assemblies.

18. A support unit according to claim 16 and further comprising a plurality of elongate narrow floor rails and additional hydraulic rams connected between the rear frame assembly and the floor rails.

19. A mineral mining installation employing at least one support unit according to claim 18 in combination with a conveyor disposed between the forward and rear assemblies of the support unit and guide means for guiding a mineral winning machine for movement back and forth alongside the conveyor, wherein the conveyor is supported on the floor rails of the unit and the machine guide is connected to one or more of the floor rails for movements therewith.

20. An installation according to claim 19, wherein hydraulic rams are connected between the rear frame assembly of the support unit and the conveyor which is slidably supported on the floor rails.

* * * * *